US012251753B2

(12) United States Patent
Maier et al.

(10) Patent No.: US 12,251,753 B2
(45) Date of Patent: Mar. 18, 2025

(54) METHOD AND DEVICE FOR PRODUCING A DIE-CAST PART

(71) Applicant: Bayerische Motoren Werke Aktiengesellschaft, Munich (DE)

(72) Inventors: Josef Maier, Weihmichl (DE); Sascha Mueller, Unterneuhausen (DE); Guenther Kahl, Munich (DE); Michael Dechene, Erding (DE); Manfred Tremmel, Niederaichbach (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 249 days.

(21) Appl. No.: 14/708,756

(22) Filed: May 11, 2015

(65) Prior Publication Data

US 2015/0239041 A1 Aug. 27, 2015
US 2017/0028463 A9 Feb. 2, 2017

Related U.S. Application Data

(63) Continuation of application No. PCT/EP2013/072333, filed on Oct. 24, 2013.

(30) Foreign Application Priority Data

Nov. 12, 2012 (DE) ..... 10 2012 220 513.6

(51) Int. Cl.
*B22D 17/32* (2006.01)
*B22D 2/00* (2006.01)
*B22D 17/14* (2006.01)

(52) U.S. Cl.
CPC ..... *B22D 17/32* (2013.01); *B22D 2/00* (2013.01); *B22D 2/006* (2013.01); *B22D 17/145* (2013.01)

(58) Field of Classification Search
CPC ... B22D 17/14–145; B22D 17/32; B22D 2/00
See application file for complete search history.

(56) References Cited

U.S. PATENT DOCUMENTS 2,624,195 A * 1/1953 Van Alen ..... G01N 25/68 136/204
5,460,041 A * 10/1995 Andes ..... G01N 25/64 374/148

(Continued)

FOREIGN PATENT DOCUMENTS

CN 1394153 A 1/2003
CN 1701878 A 11/2005

(Continued)

OTHER PUBLICATIONS

Machine Translation of Uemura (JP H07-068365A, Mar. 14, 1995).*

(Continued)

*Primary Examiner* — Kevin E Yoon
*Assistant Examiner* — Jacky Yuen
(74) *Attorney, Agent, or Firm* — Crowell & Moring LLP

(57) ABSTRACT

A method is provided for producing a die-cast part by means of a die-casting die, wherein air contained in the die-casting die is sucked out. A moisture contained in the air that is sucked out is measured. In the method, the moisture is measured while the air is sucked out. A device for producing a die-cast part, which device has a diecasting die, a suction apparatus for sucking out air present in the die-casting die, at least one sensor for detecting the moisture in the air that is sucked out, and a control apparatus for controlling the device, is designed to perform the method.

14 Claims, 2 Drawing Sheets

(56) References Cited

U.S. PATENT DOCUMENTS

| | | | | |
|---|---|---|---|---|
| 5,460,218 | A | 10/1995 | Miwa et al. | |
| 5,566,743 | A | 10/1996 | Guergov | |
| 6,082,435 | A | 7/2000 | Suzuki et al. | |
| 6,125,911 | A | 10/2000 | Wuest et al. | |
| 6,557,617 | B1 * | 5/2003 | Bagnoud | B22D 17/32 164/4.1 |
| 2002/0118027 | A1 * | 8/2002 | Routkevitch | A61L 27/06 324/694 |
| 2003/0041993 | A1 | 3/2003 | Kuramasu et al. | |
| 2007/0294093 | A1 | 12/2007 | Galt | |
| 2007/0299706 | A1 * | 12/2007 | Galt | B22D 17/32 705/7.11 |
| 2012/0247203 | A1 * | 10/2012 | Zhang | G01N 27/223 73/335.04 |
| 2013/0000384 | A1 * | 1/2013 | Yamaguchi | B22D 2/006 73/31.04 |

FOREIGN PATENT DOCUMENTS

| | | | | | |
|---|---|---|---|---|---|
| CN | 2811996 | Y | | 8/2006 | |
| CN | 201940399 | U | | 8/2011 | |
| DE | 196 28 870 | A1 | | 1/1998 | |
| DE | 693 14 285 | T2 | | 4/1998 | |
| DE | 197 44 481 | A1 | | 4/1999 | |
| DE | 100 48 033 | A1 | | 5/2002 | |
| DE | 696 28 139 | T2 | | 2/2004 | |
| DE | 20 2007 019 440 | U1 | | 9/2012 | |
| DE | 102 13 329 | B4 | | 9/2013 | |
| EP | 0 982 089 | A1 | | 3/2000 | |
| EP | 1 252 949 | A1 | | 10/2002 | |
| JP | 61-92768 | A | | 5/1986 | |
| JP | 3-174965 | A | | 7/1991 | |
| JP | 7-68365 | A | | 3/1995 | |
| JP | 10-156510 | A | | 6/1998 | |
| JP | 2005111478 | A | * | 4/2005 | |
| JP | 2006-239710 | A | | 9/2006 | |
| JP | 2007222896 | A | * | 9/2007 | |
| WO | WO-2011115276 | A1 | * | 9/2011 | B22D 17/32 |
| WO | WO-2012100789 | A1 | * | 8/2012 | B22D 17/14 |

OTHER PUBLICATIONS

"Humidity Temperature Meter Instruction Manual", Digital temperature and Hygrometer MS-6503, Precision Mastech Enterprises Co., LTD, 2004. (Year: 2004).*

"Humidity-Temperature Probe with USB-Interface", CON-HYTELOG-USB-SET1, Hygrosens Instruments GmbH, 2008. (Year: 2008).*

International Search Report (PCT/ISA/210) dated Jan. 27, 2014, with English translation (six (6) pages).

German Search Report dated Jul. 24, 2013, with partial English translation (ten (10) pages).

"Feuchte-Temperaturfühler mit Usb-Schnittstelle", http://www.produktinfo.conrad.com/datenblaetter/175000-199999/183018-da-01-de-Feuchte_Temp_Messfuehler_Edelstahl_USB.pdf, Jan. 1, 2007 (four (4) pages).

Chinese-language Office Action issued in counterpart Chinese Application No. 201380049517.3 dated Nov. 30, 2016 with English translation (16 pages).

English translation of Chinese Office Action issued in counterpart Chinese Application No. 201380049517.3 dated Oct. 8, 2015 (seven (7) pages).

European Office Action issued in counterpart European Application No. 13782722.6 dated Feb. 28, 2017 with partial English-language translation (six (6) pages).

Chinese-language Office Action issued in counterpart Chinese Application No. 201380049517.3 dated Feb. 11, 2019 with English translation (17 pages).

German-language Office Action issued in German Application No. 10 2012 220 513.6 dated Jun. 27, 2022 (four (4) pages).

* cited by examiner

METHOD AND DEVICE FOR PRODUCING A DIE-CAST PART

CROSS REFERENCE TO RELATED APPLICATIONS

This application is a continuation of PCT International Application No. PCT/EP2013/072333, filed Oct. 24, 2013, which claims priority under 35 U.S.C. § 119 from German Patent Application No. 10 2012 220 513.6, filed Nov. 12, 2012, the entire disclosures of which are herein expressly incorporated by reference.

BACKGROUND AND SUMMARY OF THE INVENTION

The present invention relates to a method and an apparatus for producing a die-cast part.

The production of components by die casting is well known in the art. In this case, a generally two-part permanent mold is closed, and a molten material is introduced at high pressure and at relatively high speed into the mold. The molten material is allowed to solidify under pressure. Thereafter, the mold is opened, the workpiece is removed, the mold is cleaned if necessary, and a new casting cycle (shot) can begin. The cycle often begins with the application of a release or lubricating agent which is also intended to prevent adhesion of the material to the metal of the mold. Despite the mold being blown dry, residual humidity can remain in the mold. Residual humidity in die-casting molds can, even during the casting process, pass into the mold cavity, for example owing to a vacuum, defective sprues, leaks etc., and can lead to increased porosity in the cast part and, at worst, to rejects. If such residual humidity is first detected in the event of casting problems or an increased reject rate, then humidity problems can be addressed only at a late point-in-time. It may then be the case that a large number of parts have already been produced, which can lead to increased reject costs and possible supply problems.

From DE 196 28 870 A1, it is known for a die-casting mold to be evacuated by way of a suction line before being filled with a casting material, wherein a reference chamber can be formed in the suction line by way of two shut-off valves connected in parallel. After closure of the shut-off valves, approximately the same ambient parameters prevail in the reference chamber as prevailed in the die-casting mold before the closure of the shut-off valves. A measurement of the ambient parameters such as residual humidity, temperature and/or pressure is performed within the closed reference chamber by use of sensors. The measured values are used for controlling the casting process. To attain the specified response time of the sensors, which according to DE 196 28 870 A1 is approximately 15 seconds, the measurement is performed within a time range of 10-30 seconds.

In the implementation of the method discussed above, the minimum cycle time is limited by the time required for the measurement. In the case of a measurement time of 10 seconds, it is possible to perform a maximum of 360 shots per hour, and in the case of a measurement time of 30 seconds, it is possible to perform a maximum of 120 shots per hour. Technically, approximately attainable shorter cycle times of up to 1000/hour (http://de.wikipedia.org/wki/Druckguss) cannot be utilized. The outlay in terms of equipment and control in order to realize the reference chamber is high, and no further evacuation is possible after the formation of the reference chamber.

The invention is based on the object of avoiding the disadvantages of the prior art and providing an improved method and a corresponding apparatus for producing a die-cast part.

The above object is achieved by a method and apparatus according to the invention. Features and details described in conjunction with the method according to the invention self-evidently also apply in conjunction with the apparatus according to the invention and vice versa in each case, such that with regard to the disclosure, reference is always, and can always be, made reciprocally to the individual aspects of the invention.

According to one aspect of the invention, a method for producing a die-cast part by use of a die-casting mold is provided, wherein air contained in the die-casting mold is extracted by suction, wherein a humidity content in the suction-extracted air is measured. In the method, the humidity content is measured during the suction extraction process.

Since the air situated in the die-casting mold is extracted by suction, that is to say the die-casting mold is evacuated, a residual humidity content in the die-casting mold can be reduced. By measuring the humidity content in the suction-extracted air, it is also possible to infer the residual humidity content in the die-casting mold, because the suction-extracted air corresponds to the air contained in the die-casting mold. Thus, from the humidity content in the suction-extracted air, it is also possible to infer the quality of the vacuum. It is thus possible for an increased residual humidity content in the die-casting mold to be addressed at an early point-in-time, and for the evacuation or other process steps to be adapted thereto. In this way, it is also possible for the formation of porosities and shrinkage cavities to be prevented, and for the quality of the casting to be improved. Since, according to the present invention, the measurement is performed during the suction extraction process, it is not necessary to wait for a measurement to be performed in a closed-off reference chamber. In fact, there is no need whatsoever for a reference chamber for capturing the ambient parameters. Rather, the humidity content is in effect measured in real-time, and is directly available as a method parameter. This altogether simplifies the construction and the control of a die-casting installation. Also, shorter cycle times are possible because the need to await the formation of a reference chamber and the subsequent measurement is eliminated.

The suction extraction process (and measurement) preferably takes place before the injection of the casting material. It may, however, be desirable for the suction extraction process and casting process to at least partially overlap. In this case, it is advantageous for the suction line not to be shut off for the purposes of forming a reference chamber, because only in this way is an overlap of the suction extraction process and casting process possible. It may also be advantageous for the suction line to be free from casting material during the injection process, such that any air still contained in the die-casting mold can be forced out of the die-casting mold through the suction line. This is only possible if the suction line is not shut off. The measured humidity content is preferably a relative humidity, though it may also be an absolute humidity content. The measurement is preferably performed using a suitable sensor. It is self-evident that air is only one example of an arbitrary gas which is contained in the die-casting mold and which can include a humidity content.

In a preferred embodiment, the method may be refined such that a temperature and/or a pressure of the suction-extracted air are/is additionally measured. From a humidity content and temperature, it is possible to infer a dewpoint, absolute humidity, enthalpy and vapor pressure. A pressure measurement additionally permits improved control of the vacuum.

In a preferred embodiment, the method may be refined such that process parameters of the method are controlled and/or regulated on the basis of the measured characteristics of the suction-extracted air. Within the context of the invention, a process parameter may be understood to mean any parameter relating to the casting process, the hardening process, the control of the mold including the control of the temperature thereof, the cleaning of the mold, an application of release agent and subsequent blowing-out process, or the evacuation process itself. In this way, it is also possible to permit improvements in process control, an optimization of the evacuation such that the vacuum is not too intense but not too weak. As a result, the casting quality can be further improved, and the cycle times can be further shortened.

In a preferred embodiment, the method may be refined such that the measurement is performed close to the die-casting mold. In this way, direct access to ambient parameters within the mold is also possible, and a time delay between the emergence of air from the mold and the measurement can be minimized.

In a preferred embodiment, the method may be refined such that a defined measurement time for the measurement is set, wherein the measurement time is less than 10 seconds, and is preferably approximately one second or less.

If a defined measurement time is known, it is possible by numerical evaluation, even in the presence of not absolutely steady-state conditions, to ensure back-calculation to present characteristics, for example by interpolation or extrapolation of variable parameters. In this way, and by means of an extremely short measurement time, it is also possible to perform a quasi-continuous measurement or a measurement virtually in real-time. In this case, a response time of the sensor is preferably shorter than the selected measurement time. Nevertheless, even if the response time of the sensor is longer than the selected measurement time, it is possible even with an incompletely acquired measurement to obtain a meaningful result if the measurement time is known and the transient response of the sensor and/or the response delay is compensated or simulated mathematically.

In an alternative, likewise equally preferable embodiment, the method may be refined such that the measurement is performed continuously. For this purpose, as already indicated above, it is preferably the case that the transient response of the sensor or the response delay is compensated or simulated mathematically. It is possible to perform a measurement virtually in real-time and to realize good control of the measurement values.

In a preferred embodiment, the method may be refined such that a sensor for detecting the measured characteristic(s) is cleaned between two measurement times, preferably at least once within a casting cycle, wherein the sensor is preferably sprayed with a cleaning medium and is particularly preferably blown clean using compressed air after being sprayed. By way of a cleaning process, it is possible, in particular, for deposits to be removed by way of release agent vapor, such that the cleaning medium is preferably coordinated with the release agent that is used. The cleaning should preferably be performed as quickly as possible in order to avoid faults in the measurement. "Cleaning medium" may refer to water on its own or in a solution with a chemical, wherein the expression "chemical" may encompass synthetic chemicals and also biological or naturally occurring chemicals.

In a preferred embodiment, the method may be refined such that the suction extraction is implemented by connection to a vacuum source. As a vacuum source, use may be made of a negative-pressure accumulator, a vacuum pump or the like. Such equipment technology is inherently well-known, manageable and easily controllable. In the case of a negative-pressure accumulator being used as a substantially passive source, the method is, in terms of this aspect, more fail-safe with regard to a sudden pump failure.

According to a further aspect of the invention, an apparatus for producing a die-cast part is provided, wherein the apparatus has a die-casting mold, a suction extraction device for the suction extraction of air situated in the die-casting mold, at least one sensor for detecting a humidity content of suction-extracted air, and a control device for controlling the apparatus. According to the invention, the apparatus is set up and configured for carrying out the method described above. Substantially the same advantages and effect are attained by way of the apparatus as are obtained by the method according to the invention.

In a preferred embodiment, the apparatus may be refined such that the sensor has a response time of less than 1 second. In this way, a measurement can be fully completed within 1 second, permitting a quasi-continuous measurement with high measurement resolution and accuracy.

In a preferred embodiment, the apparatus may be refined such that the sensor is configured for detecting a relative humidity and/or a temperature. With a combined sensor, it is also possible to realize a simplification in terms of construction, calibration, adaptation and measurement value processing.

In a preferred embodiment, the apparatus may be refined such that the sensor is arranged in a suction line, preferably close to the connection or directly at the connection to the die-casting mold. As already mentioned, by use of a sensor location as close to the mold as possible, it is possible to realize substantially direct access to ambient parameters within the mold, with the advantages and effects already described above.

In a preferred embodiment, the apparatus may be refined such that a protective cap is provided on the sensor, wherein the protective cap is preferably optimized with regard to an incident flow. By means of a protective cap of this type, it is possible for flow effects (dynamic pressure, etc.) on the measurement to be reduced. Likewise, by optimization of an incident flow, turbulence of the suction flow in the suction line caused by the sensor can be reduced.

In a preferred embodiment, the apparatus may be refined such that the sensor is installed in a housing with an inspection glass, so as to also permit effective visual inspection of a level of fouling. The housing preferably forms a part of a flow path for the suction-extracted air, for example by virtue of the housing being installed directly between a suction extraction connection on the die-casting mold and a suction line.

In a preferred embodiment, the apparatus may be refined such that a first suction line and a second suction line are provided, wherein the sensor is preferably provided only in one out of the first and second suction lines. Numerous advantages and effects can be attained by such a construction. Firstly, the evacuation can be performed more rapidly and in a more fail-safe manner. If the suction line with the sensor additionally exhibits relatively low suction power, the occurring flow speeds are lower, and the flow and measurement conditions are more steady-state. This can also lead to improved response behavior of the sensor and/or to improved numerics in the evaluation of the measurement data. The suction line with the sensor can be optimized for reliable measurement, whereas the suction line without the sensor can be optimized for the evacuation process itself, for example for the most rapid evacuation possible.

Other objects, advantages and novel features of the present invention will become apparent from the following detailed description of one or more preferred embodiments when considered in conjunction with the accompanying drawings.

DETAILED DESCRIPTION OF THE DRAWINGS

Preferred exemplary embodiments and design variants will be explained in detail below on the basis of the appended drawings. It is self-evident that the drawings are purely schematic and may illustrate features in enlarged form, or so as to be highlighted in some other way, for the purposes of illustrating the invention, without this being intended to constitute an accurate scale of the proportions.

Figure 1:
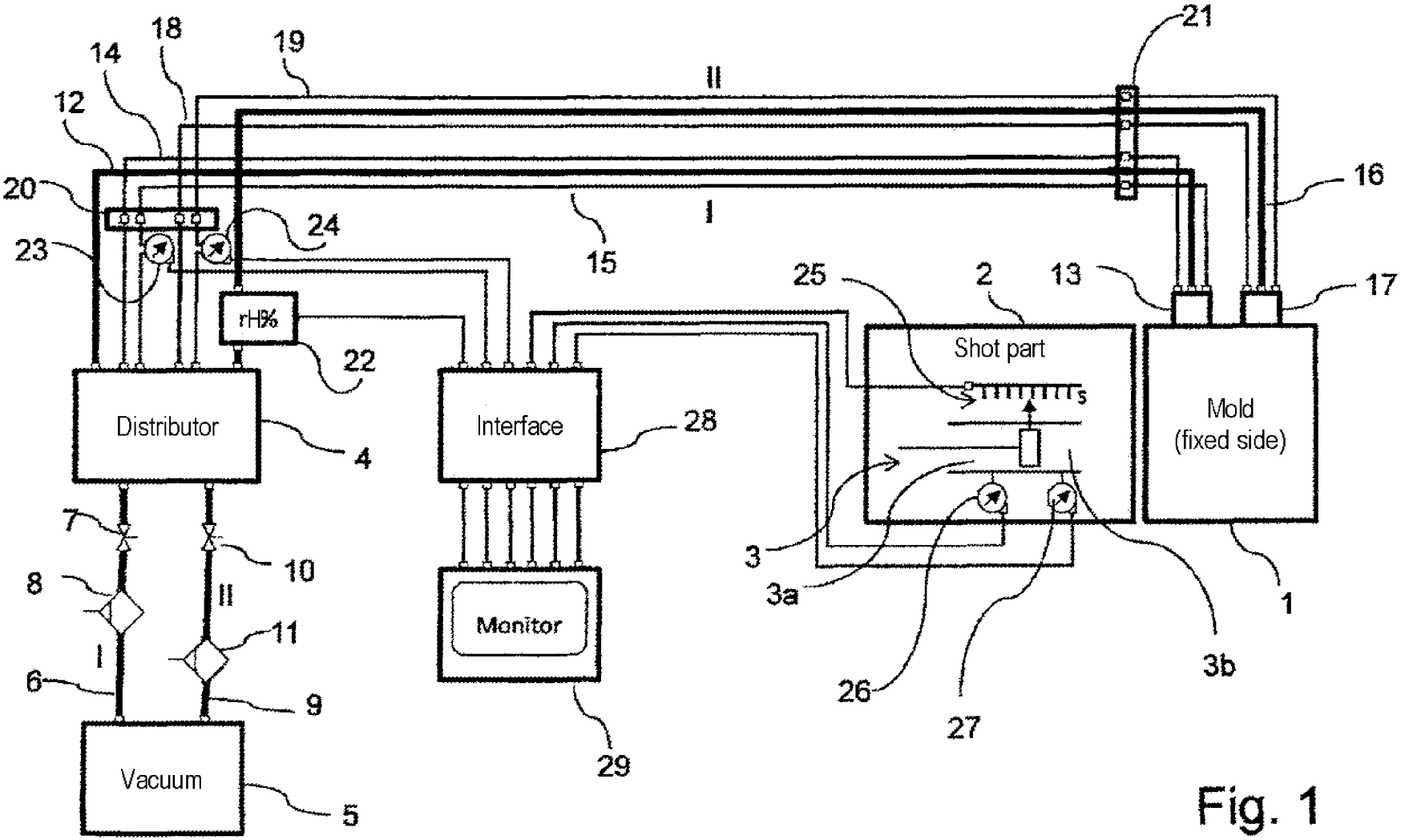
FIG. 1 is a schematic overview illustration of a die-casting installation, for the purpose of illustrating an exemplary embodiment of the present invention.

FIG. 1 schematically illustrates a die-casting installation with elements of relevance for the understanding of the invention. Certain elements that are necessary or expedient for the operation of a die-casting installation have been omitted in order to simplify the illustration. The die-casting installation described here is an apparatus within the context of the invention.

As per the illustration in FIG. 1, a die-casting installation has a die-casting mold 1, a shot part 2 with a piston 3, a vacuum distributor 4, and a vacuum source 5. In the figure, only the fixed side of the die-casting mold 1 is illustrated, and only the piston 3 and various measurement instruments of the shot part 2 are schematically illustrated. It is self-evident that the die-casting mold 1 may have further parts such as removable and closable mold parts (movable side), connections, measurement devices, a cleaning device, release agent applicator, blowing-out measures and the like. The piston 3 of the shot part 2 may also be understood to be part of, or may be integrated in, the movable side of the die-casting mold 1. The shot part 2 may also be formed as the sole physical part of the movable side of the die-casting mold 1.

By way of the shot part 2 or the piston 3, a liquid metal can be injected into the mold, which liquid metal remains in the mold under pressure until it solidifies in order to form a workpiece. As has already been described above, the workpiece is removed from the mold after solidifying, and the mold is then cleaned, wetted with a release agent, and possibly blown clean using compressed air. After subsequent closure of the mold, the latter is evacuated in order to reduce the residual humidity content, and the next injection is performed to produce the next workpiece.

To evacuate the mold 1, the mold is connected to a vacuum distributor 4, which in turn is connected at a primary side to a vacuum source 5. The evacuation system is of secondary construction, symbolized in the figure by I, II. In strand I, the vacuum distributor 4 is connected at the primary side via a vacuum line 6 to the vacuum source 5. A valve 7 for controlling a connection state is arranged in the vacuum line 6. Furthermore, a separator 8 is arranged in the vacuum line 6 in order to move humidity from the air that is drawn-in. In the same way, in strand II, a vacuum line 9, in which a valve 10 and a separator 11 are arranged, is provided for connecting the vacuum distributor 4 to the vacuum source 5. The vacuum source 5 may, for example, be a vacuum tank (not illustrated in any more detail) which is evacuated by way of a vacuum pump (not illustrated in any more detail) to ambient air in order to maintain a predetermined negative pressure. Alternatively, a vacuum pump (not illustrated in any more detail) may be provided for each strand I, II. The valves 7, 10 and the vacuum source 5 are connected to an installation controller for controlling the connection state of the vacuum lines 6, 9 and the negative pressure provided by the vacuum source 5.

At the secondary side, the vacuum distributor 4 is, in strand I, connected via a vacuum line 12 to a vacuum block 13, which in turn is attached to the die-casting mold 1. Furthermore, two signal lines, specifically a control line 14 and a measurement line 15, extend from the vacuum distributor 4, which signal lines are likewise connected to the vacuum block 13. In the same way, strand II is constructed at the secondary side by a vacuum line 16, a vacuum block 17, a control line 18 and a measurement line 19. Two cable holders 20, 21 are provided for gathering and supporting the lines 12, 14-16, 18 and 19. The cable holders 20, 21 may also be configured as connector panels, which the lines 12, 14-16, 18 and 19 each run into at the distributor side and at the mold side such that, in the event of local repositioning of the die-casting arrangement 1, 2 or of the primary-side vacuum arrangement 4-10, or in the event of exchange of the mold 1 for a different mold, the mold-side or distributor-side connections do not have to be released, and thus mechanical loading, sealing problems or loosening of the connections at the mold 1 and/or at the vacuum distributor 4 can be avoided.

A humidity sensor 22 is provided in the secondary-side vacuum line 16 of the strand II. The humidity sensor 22 is designed for measuring a relative humidity content in the air that is extracted by suction via the vacuum line 16. It is advantageously also possible for the sensor to be set up for measuring a temperature of the air that is extracted by suction via the vacuum line 16. Using the parameters of relative humidity rH and temperature T, it is, for example, also possible to calculate the absolute humidity.

Furthermore, in each case one pressure gauge 23, 24 for the measurement of the respective pressure is arranged in the measurement lines 15, 19.

Further measurement technology is provided in the shot part 2. Here, a position encoder 25 outputs an advancement travel s of the piston 3, and two pressure gauges 26, 27 output a pressure in an annular chamber 3*a* and in a metal chamber 3*b*, respectively, of the piston 3.

The humidity sensor 22, the pressure gauges 23, 24, 26, 27 and the position encoder 25 are connected via signal lines (not shown any more detail) to an interface 28, which in turn is coupled to a monitor 29 for the monitoring of the operating parameters.

The distributor 4 and the interface 28 are connected to the installation controller. The installation controller controls and/or regulates operating parameters such as piston pressure, metal temperature, vacuum pressure, etc. The interface 28 and/or the monitor 29 may have input elements (not illustrated in any more detail) such as switches, keyboards, mouse pointers, etc., in order to enable an operator to input and/or manipulate preset values. By means of an incorporation of the humidity sensor 22, the installation controller may also be configured to perform an automatic process termination beyond a certain threshold value. The threshold value may, for example, be predefined so as to specify a threshold beyond which a residual humidity content in the mold is so high that unacceptably high losses in quality are to be expected owing to shrinkage cavity formation or porosity in the cast part.

A humidity and temperature sensor which is commercially available under the designation CON-HYTELOG-USB has, for example, proven to be suitable as the humidity sensor 22. This sensor has a precision NTC for temperature detection and a capacitive polymer sensor, with long-term stability, for the measurement of the relative humidity, and is produced in various configurations. In a first configuration, the sensor has a measurement range for the relative humidity of 10 to 95% with a typical accuracy of ±3% and a measurement range of −20 to +60° C. for the temperature. In a second configuration, a measurement range for the relative humidity of 0 to 100% is attained, with a typical accuracy of ±2%, and the measurement range for the temperature is −40 to +80° C. For both configurations, the resolution for the relative humidity is typically 0.01%, and for the temperature, the resolution is 0.01 K and the accuracy is ±0.5K between 0 and +40° C. The sensor has a USB plug connector for direct connection to a PC, wherein the supply of power is likewise realized via the USB connection. For communication with the sensor, COM port emulation is provided. Further details regarding the characteristics and the control of the sensor can be gathered, for example, from a product datasheet available at http://www.produktinfo-.conrad.com/datenblaetter/175000-199999/183018-da-01-de-FEUCHTE_TEMP_MESSFUEHLER_EDELSTAHL_USB.pdf (accessed on 08.10.2012).

A particular advantage of the humidity sensor has proven to be the response behavior, which has a response time of less than 1 second. In this case, a response time is understood to mean the time that elapses until the sensor, in the event of a change in ambient parameters, exhibits a preferably stable change in output that can be evaluated for control and/or regulation purposes in the context of the evacuation of a die-casting installation according to the present invention.

In the case of a sensor of the type being used in a humidity measurement system at the die-casting mold, immediate, very sensitive detection of residual humidity content is possible. In this way, such process disruptions can be reacted to immediately. This results in a reduction in the reject rate owing to shorter feedback times, and in improved quality of the die-cast parts. Furthermore, pore-sensitive processes such as LOS can be made more easily possible.

The use of two vacuum lines (or suction lines) 12, 16 has the further advantage, aside from increased fail-safety, that the suction power in the first vacuum strand I and in the second vacuum strand II can be controlled and/or regulated differently. For example, the first vacuum strand I can be configured for a maximum suction power in order to be able to evacuate the mold 1 as rapidly as possible. By contrast, the second vacuum strand II may be configured for the most distinct and fast-responding measurement possible.

Figure 2:
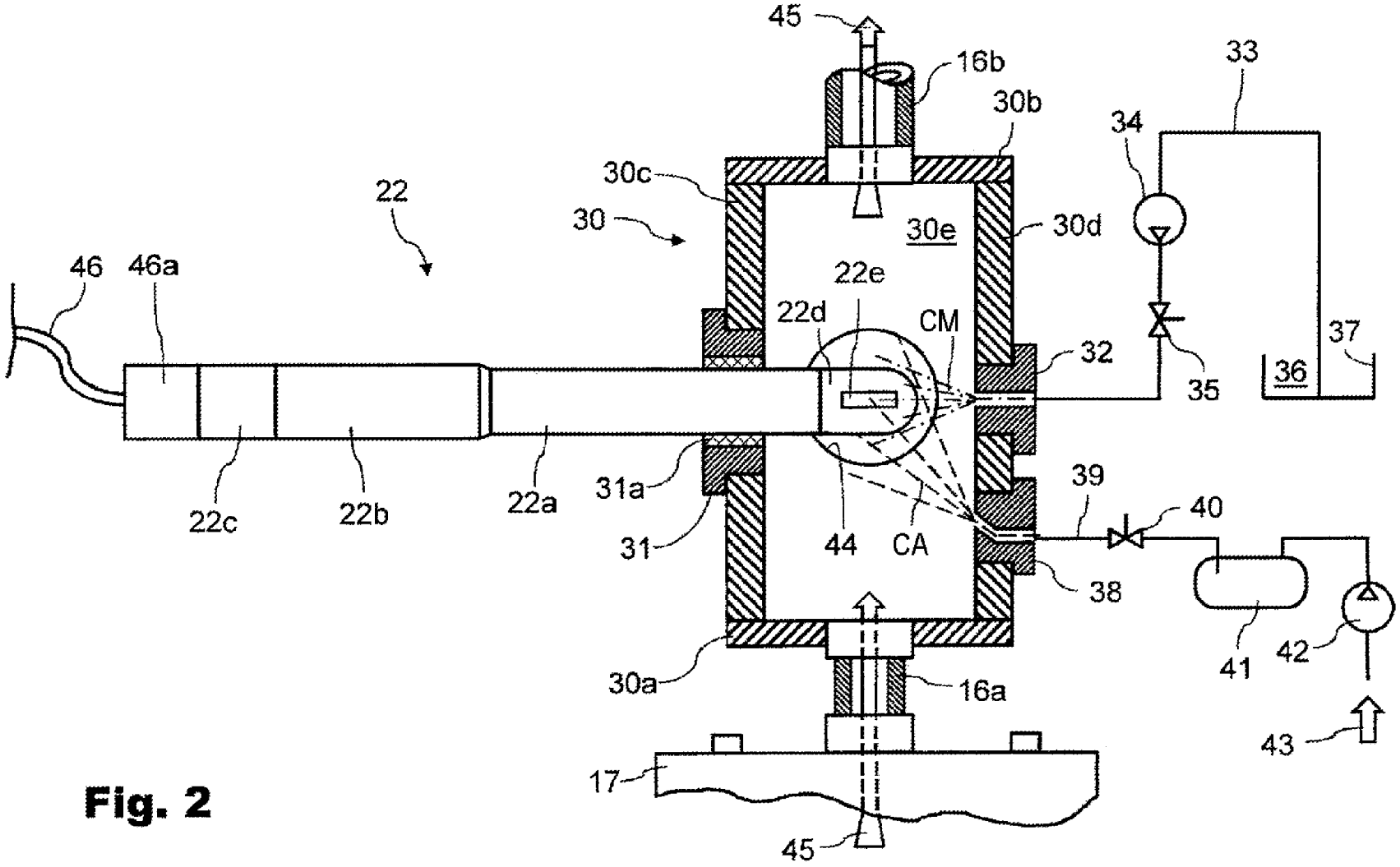
FIG. 2 is a schematic partially sectional illustration of a sensor arrangement, for the purpose of illustrating a design variant.

FIG. 2 shows, in a schematic, partially sectional illustration, an arrangement of a temperature sensor 22 with a sensor housing in a modification of the exemplary embodiment of FIG. 1.

In the present design variant, a sensor housing 30 is provided, which is attached directly to the vacuum block 17 of the second vacuum strand II (cf. FIG. 1) of the die-casting mold 1 (cf. FIG. 1). More precisely, a face side 30*a* of the sensor housing 30 is connected via a short line piece 16*a* of the secondary-side vacuum line 16 of the second vacuum strand II (cf. FIG. 1) to a vacuum port (not illustrated in any more detail) of the vacuum block 17. Connected to an opposite face side 30*b* is a line piece 16*b* which leads to the mold-side cable holder 21 (cf. FIG. 1) and which forms a piece of the secondary-side vacuum line 16 of the second vacuum strand II (cf. FIG. 1).

In a side wall 30*c* there is provided a screw-in piece 31 through which the humidity sensor 22 can be inserted into an interior space of the sensor housing 30. More precisely, the humidity sensor 22 has a sensor tube 22*a* and a handle 22*b*, wherein a connection part 22*c* is provided on a rear end of the handle 22*b*. On a forward end of the sensor tube 22*a* there is arranged a tip 22*d* with an opening 22*e*, wherein the sensors themselves of the humidity sensor 22 are accessible to ambient air via the opening 22*e*. The humidity sensor 22 is inserted through the screw-in piece 31 such that the sensor tube 22*a* bears against a seal 31*a* of the screw-in piece 31 in a circumferential direction, and the tip 22*d* projects fully into the interior space of the sensor housing 30.

On a second side wall 30*d* of the sensor housing 30, a cleaning nozzle 32 is screwed in such that a jet of a cleaning medium CM reaches the tip 22*d* of the humidity sensor 22. The release agent vapor from the casting mold (mold 1) leaves behind waxy residues during series operation, which residues are removed again by means of water, if appropriate with the addition of further synthetic and/or natural chemicals.

For the purposes of this description, "cleaning medium" is understood to encompass both water on its own and with the addition of further chemicals. This process, too, must take place very rapidly in order that the cleaning medium does not disrupt the measurement. The cleaning nozzle 32 is supplied with cleaning medium 36 from a CM reservoir 37 via a CM line 33 in which a CM pump 34 and a CM valve 35 are arranged. The cleaning medium 36 in the CM reservoir 37 may, as mentioned above, be water on its own or water with further added chemicals.

Also screwed onto the second side wall 30*d* of the sensor housing 30 is a blowing-clean nozzle 38, which is likewise directed toward the tip 22*d* of the humidity sensor 22. By way of the blowing-clean nozzle 38, the tip 22*d* of the humidity sensor 22 can, after the cleaning process, be blown clean using compressed air CA in order to minimize disruption of the measurement acquisition by the cleaning medium CM. The blowing-clean nozzle 38 is supplied with compressed air from a pressure accumulator 41 via a CA line 39 in which a CA valve 40 is situated. The pressure accumulator 41 is supplied with compressed ambient air 43 by a compressor, and is kept at a predetermined positive pressure. An arrangement for regulating the positive pressure is not illustrated in any more detail in the figure and may be readily realized in one form or another by a person skilled in the art depending on requirements.

An inspection window 44 is arranged in a third side wall 30*e* of the sensor housing 30. The inspection window 44 enables an operator to observe the sensor 22 which is exposed to the exit air 45 from the die-casting mold 45, and to react to any fouling or other undesired events.

For completeness, it is pointed out that the connection part 22*c* which is provided on the handle 22*b* of the humidity sensor 22 can, during operation, be coupled to a plug connector 46*a* of a connecting line 46, which in turn can be coupled to the interface 28 (cf. FIG. 1).

During the use of the illustrated arrangement, after the conclusion of a casting cycle, upon the starting of the vacuum device in the vacuum line 16 the residual humidity is measured. The measurement is performed directly at the mold 1, and the measurement duration is approximately 1 second. The short measurement time is advantageous because the results are available immediately, and the next casting cycle can be immediately interrupted if the measurement result is not in order. Subsequently, within a cycle, the measurement sensor is cleaned again using cleaning medium CM and compressed air CA.

Here, an advantage is realized in relation to conventional systems which operate using sensors with a longer response time. Such sensors can provide reliable results only under steady-state conditions, such that it is necessary to form a reference chamber in which an uninterrupted measurement can be performed over 10 to 30 seconds. Since the reference chamber must be realized in a suction line, no further evacuation, and thus also no further shot, can be performed during said time.

The present invention has been described above on the basis of a preferred exemplary embodiment and a number of modifications and variants, and has been illustrated by way of an example and schematically in the figures. The invention is not restricted to the exemplary embodiments illustrated and described, because these serve merely for illustrating and explaining the concept of the invention. Modifications and enhancements within the scope of expert knowledge and capabilities are encompassed by the scope of the present invention, at any rate insofar as they fall within the wording or the equivalent use of the subject matter of the appended claims.

Alternatively, it is for example possible to use sensors even with a response time of longer than 1 second. In this case, it is possible to obtain evaluable results if the response behavior is compensated mathematically. For example, in the event of a change of the measurement output, the further progression of the measurement output can be inferred already at an early point-in-time from the first-order and higher-order derivatives. Also, in this way, it is possible within certain limits to approximate to a quasi-continuous measurement, which makes it possible to identify deviations from normal behavior, in particular in relation to reference measurements, at an early point-in-time. At any rate, a measurement time should be less than 10 seconds, preferably considerably less than 10 seconds, in order to be able to optimally utilize the advantages of the arrangement according to the invention and the method according to the invention.

In a design variant which is not illustrated in any greater detail, the tip 22*d* of the humidity sensor 22 is covered by a protective hood which is optimized with regard to an optimum incident flow of the exit air for the measurement. The protective hood may, for example, be pre-integrated in a side wall of the sensor housing 30, or may be capable of being retroactively installed through an opening of the inspection window 44.

In a further modification, it is for example possible for the short line piece 16*a* to be reduced to a screw-in connector which is screwed into the face wall 30*a* of the sensor housing 30 and by which the sensor housing 30 as a whole can be screwed onto the vacuum block 17. Proceeding yet further, the vacuum block 17 may be integrated with the sensor housing 30, which further simplifies the construction.

In a design variant which is not illustrated in any greater detail, a mixing device may be provided for the admixing of a chemical from a further reservoir into the CM line 33 (cf. FIG. 2).

The line 46 may also be attached directly to the handle 22*b* without a plug-type connection.

The invention is also applicable to installations with only one vacuum line or suction line.

LIST OF REFERENCE SIGNS

1 Die-casting mold (fixed side)
2 Shot part
3 Injection cylinder
3*a* Annular chamber
3*b* Metal chamber
4 Vacuum distributor
5 Vacuum source
6 Vacuum line (primary I)
7 Vacuum valve (primary I)
8 Separator (primary I)
9 Vacuum line (primary II)
10 Vacuum valve (primary II)
11 Separator (primary II)
12 Vacuum line (secondary I)
13 Vacuum block (secondary I)
14 Control line (secondary I)
15 Measurement line
16 Vacuum line (secondary II)
16*a* Short piece
16*b* Piece
17 Vacuum block (secondary II)
18 Control line (secondary II)
19 Measurement line (secondary II)
20 Cable holder (distributor side)
21 Cable holder (mold side)
22 Humidity sensor
22*a* Sensor tube
22*b* Handle
22*c* Connection part
22*d* Tip
22*e* Opening
23 Pressure gauge (secondary I)
24 Pressure gauge (secondary II)
25 Position encoder (shot part)
26 Pressure gauge (annular chamber)
27 Pressure gauge (metal chamber)
28 Interface
29 Monitor
30 Sensor housing
30*a*, 30*b* End wall
30*c*, 30*d*, 30*e* Side wall
31 Screw-in piece
31*a* Seal
32 Cleaning nozzle
33 CM line
34 CM pump
35 CM valve
36 CM reservoir
37 Cleaning medium (CM)
38 Discharge nozzle
39 CA line
40 CA valve
41 Pressure accumulator
42 Compressor
43 Ambient air
44 Inspection window

45 Exit air
46 Measurement line
46*a* Plug connector
rH Relative humidity in %
s Travel
I First vacuum strand
II Second vacuum strand
COM (Serial) communication interface
CA Compressed air
PC Personal Computer (workstation computer)
CM Cleaning medium
T Temperature
USB Universal Serial Bus The above list of reference signs and symbols is an integral part of the description.

The foregoing disclosure has been set forth merely to illustrate the invention and is not intended to be limiting Since modifications of the disclosed embodiments incorporating the spirit and substance of the invention may occur to persons skilled in the art, the invention should be construed to include everything within the scope of the appended claims and equivalents thereof.

What is claimed is:

1. A method for producing a diecast part, comprising:
extracting air that is contained in a diecasting mold by suction through a first suction line and a second suction line;
measuring a level of humidity contained in the extracted air with a sensor enclosed in a sensor structure, wherein
the level of humidity in the extracted air is measured while the air is being extracted,
the sensor structure is attached directly to a vacuum block, without a valve interposed between the sensor structure and the vacuum block.

2. The method according to claim 1, wherein a temperature and/or a pressure of the extracted air are also measured.

3. The method according to claim 2, wherein process parameters of the method are controlled in an open-loop and/or closed-loop manner based on measured properties of the extracted air.

4. The method according to claim 3, wherein a defined measuring time is fixed for the measurement, the measuring time being less than 10 seconds.

5. The method according to claim 3, wherein the measuring of the level of humidity is performed continuously.

6. The method according to claim 5, wherein a moisture sensor configured to sense the measured property/properties is cleaned between two measuring times at least once within a casting cycle, the moisture sensor being sprayed with a cleaning agent and, after the spraying, being blasted with compressed air.

7. The method according to claim 6, wherein the extracting is performed by connecting to a vacuum source.

8. The method according to claim 1, wherein the sensor has a response time of less than 1 second, and a measurement is fully completed within 1 second.

9. The method according to claim 1, wherein the sensor structure includes a housing with an inspection glass, so as to also permit effective visual inspection of a level of fouling.

10. An apparatus for producing a diecast part, comprising:
a first suction line;
a second suction line;
a diecasting mold;
an extraction device configured to extract air by suction and being located outside the diecasting mold;
a moisture sensor that is part of a sensor structure and that is configured to sense a level of humidity of extracted air in only one out of the first and second suction lines; and
a control device configured to control the apparatus, wherein
the moisture sensor structure is attached directly to a vacuum block, without a valve interposed between the sensor structure and the vacuum block.

11. The apparatus according to claim 10, wherein the moisture sensor has a response time of less than 1 second.

12. The apparatus according to claim 11, wherein the moisture sensor is configured to sense a relative humidity and a temperature.

13. The apparatus according to claim 12, further comprising: a protective cap that is provided in the moisture sensor, the protective cap being optimized for incident flow.

14. The apparatus according to claim 13, wherein the moisture sensor is installed in a housing with an inspection window.

* * * * *